United States Patent [19]

Cadman

[11] 4,023,221

[45] May 17, 1977

[54] MULTIPURPOSE TOOL KIT AND FOLDING HANDLE THEREFOR

[76] Inventor: Russell O. Cadman, Rte. 2, Box G-90, Garfield, Ark. 72732

[22] Filed: Sept. 11, 1975

[21] Appl. No.: 612,499

[52] U.S. Cl. ..... 7/1 R; 7/14.55; 206/374; 7/13 B

[51] Int. Cl.[2] ..... B25F 1/02; A45C 11/26

[58] Field of Search ..... 7/1 R, 13 B, 14.55, 7/15; 206/223, 230, 234, 372, 373, 374, 375, 526, 275

[56] References Cited

UNITED STATES PATENTS

| | | | |
|---|---|---|---|
| 559,509 | 5/1896 | Zinn | 7/14.55 |
| 576,756 | 2/1897 | Cole | 7/14.55 |
| 1,654,958 | 1/1928 | Breton | 7/14.55 |
| 2,554,680 | 5/1951 | Morris et al. | 206/374 |

FOREIGN PATENTS OR APPLICATIONS

| | | | |
|---|---|---|---|
| 55,721 | 10/1913 | Austria | 7/14.55 |
| 1,021,931 | 2/1953 | France | 206/373 |
| 38,515 | 12/1923 | Norway | 145/2 A |

*Primary Examiner*—Al Lawrence Smith
*Assistant Examiner*—Roscoe V. Parker
*Attorney, Agent, or Firm*—Burns, Doane, Swecker & Mathis

[57] ABSTRACT

A compact, lightweight tool kit and folding handle therefor, are disclosed. The tool kit includes a plurality of tool implements each of which may perform one or more work functions. Each tool implement may be connected to the folding handle and is provided with a device to prevent relative rotation therebetween. The handle may be used in either a folded or an extended position with each tool implement, and is provided with a latch device to retain the following handle in a folded, an extended or an intermediate position. In the intermediate position a saw blade may be affixed to the handle.

8 Claims, 10 Drawing Figures

FIG.1.
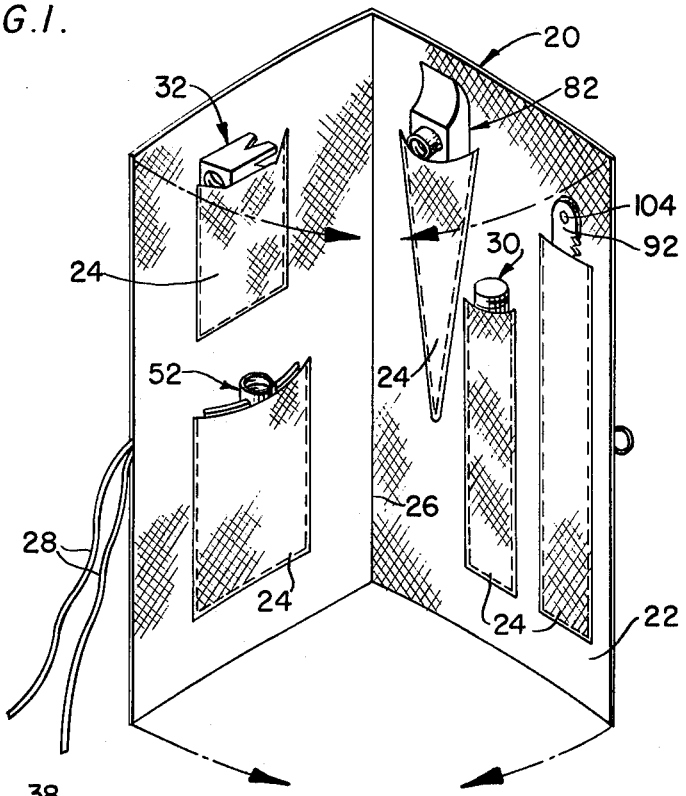
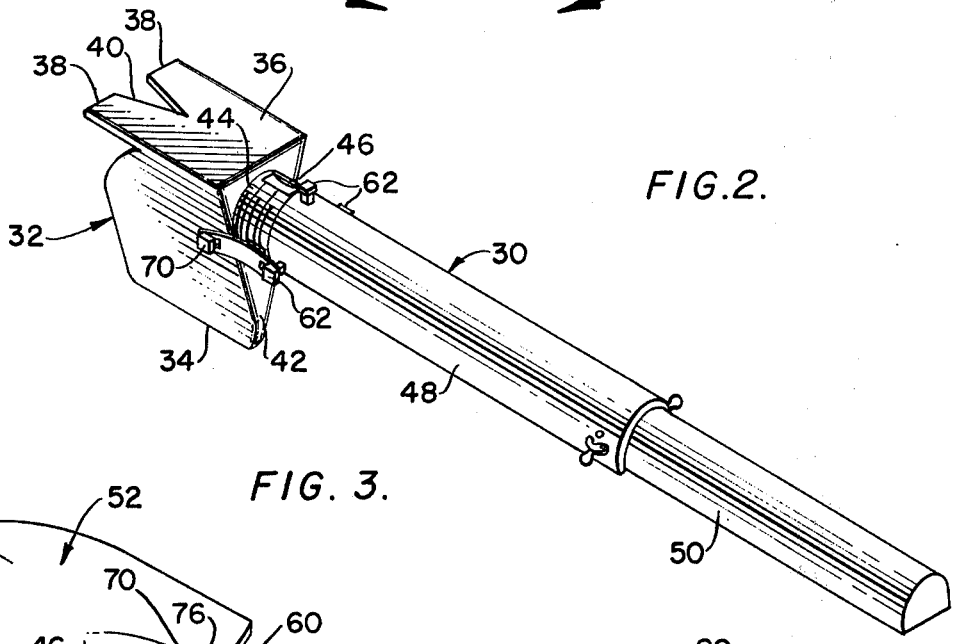
FIG.2.
FIG. 3.
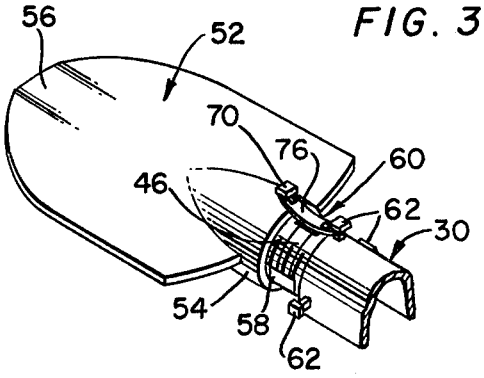
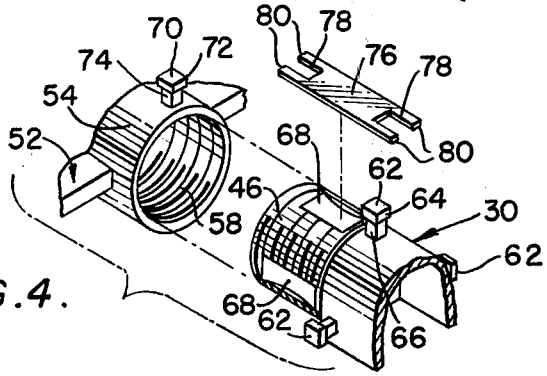
FIG.4.

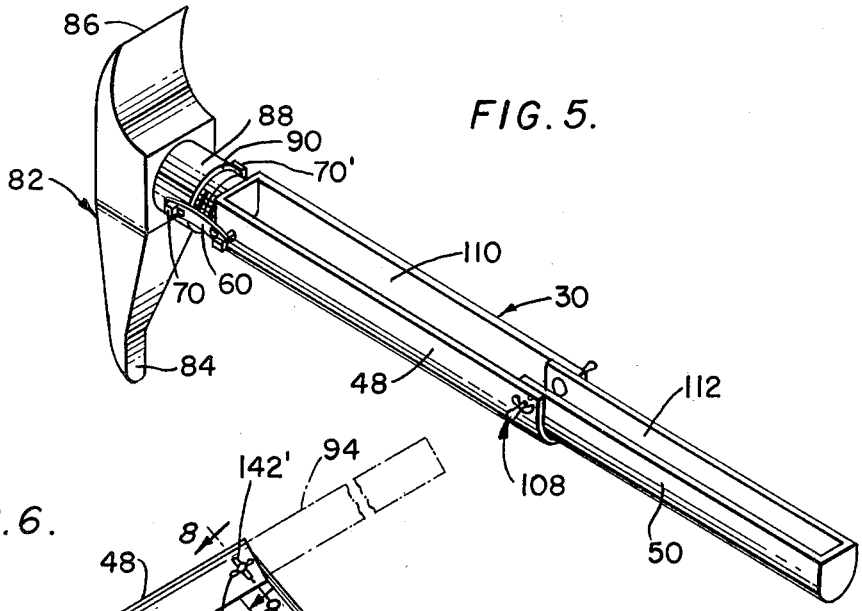
FIG. 5.
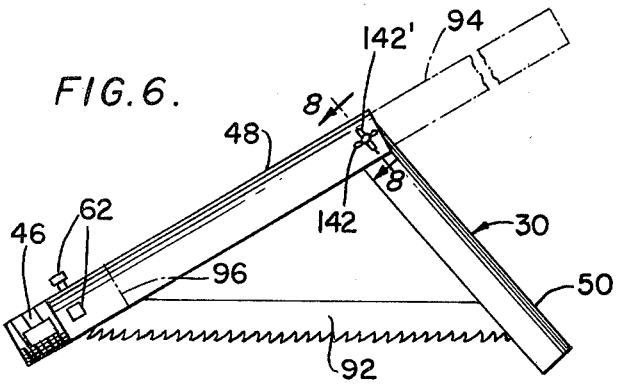
FIG. 6.
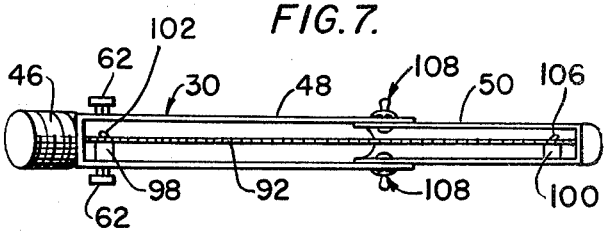
FIG. 7.
FIG. 8.
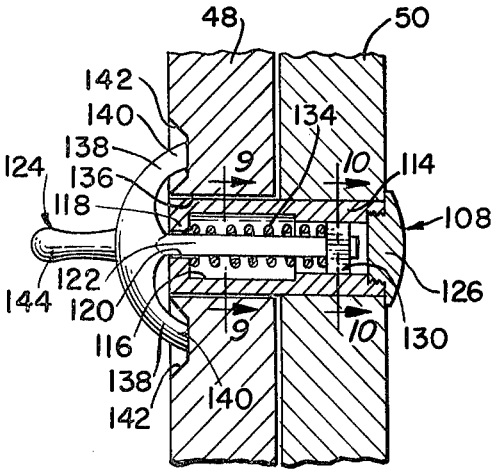
FIG. 9.
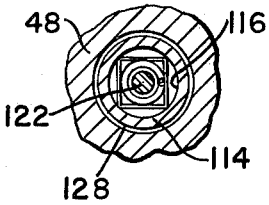
FIG. 10
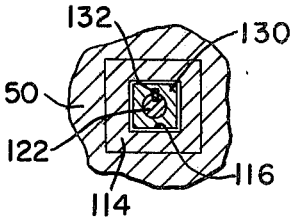

MULTIPURPOSE TOOL KIT AND FOLDING HANDLE THEREFOR

BACKGROUND OF THE INVENTION

The invention relates generally to a tool kit having a plurality of tool implements therein. More specifically, the invention concerns a tool kit having a folding handle and means whereby the handle is detained in either a folded or an extended position.

Hunters, campers, sportsmen and other outdoorsmen oft-times have need for and use various types of cutting and digging tools. When these types of people are in wilderness areas or in environments where they must carry all or most all of their supplies with themselves, weight becomes an important consideration. Accordingly, typically only a hatchet or a trench shovel is carried by these individuals.

When using either a hatchet or a trench shovel, little flexibility is possible in the types of cutting and digging tasks which may be performed without substantially duplicating the weight of the implements which must be carried.

Accordingly, it is one object of the present invention to provide a lightweight, multipurpose tool kit suitable for use by sportsmen, outdoorsmen and the like which provides a plurality of cutting and digging implements.

In the past, it has been proposed to substitute multifunction combination tools for a hatchet or a shovel to increase the variety of functions which may be performed. Such devices, however, compromise the efficacy of the basic tool around which they are designed. For example, if a shovel were given a cutting edge, such that it could operate as both a shovel and an axe, when used as an axe, the shovel would be rather unwieldy in addition to having an unfamiliar shape adding to the difficulty of its use.

It is, therefore, an object of the present invention to provide a novel tool kit having tool implements designed in conformity to conventional shapes to facilitate their use as well as to avoid compromising their efficacy.

A further object of the present invention is to provide a novel tool kit having a plurality of tool implements which are adapted for connection with a single tool handle.

As is well known, outdoorsmen often need to cut objects in a manner not suited to the use of an axe. It is necessary, therefore, for the outdoorsmen to use a saw which is not usually available since the outdoorsmen would ordinarily not desire to carry a saw.

Thus, another object of the present invention is to provide a tool kit which is provided with a saw blade to be used in those events when it is needed.

When the outdoorsman has a need to dig, a shovel typically is adequate for his purposes. There are instances, however, when digging in stony or extremely well-packed soil, that a shovel by itself is insufficient. In these instances, a pick or some other suitable type of instrument is needed to loosen the soil and facilitate removal thereof. Accordingly, it is an object of the present invention to provide a novel tool kit that permits use of a pick.

When travelling through and working in wooded areas, long handles of conventional shovels, picks, axes and the like, are more of a hindrance than a help due to dense foliage, vegetation, etc. It would clearly be impractical for an outdoorsman to carry two such implements, one with a short handle, and one with a long handle.

Accordingly, it is an object of the present invention to provide a novel tool kit having a handle which may be folded between an extended position and a folded position, to provide a single handle with duplicate functions.

From the foregoing, it will be apparent that a need still exists for a truly versatile tool kit which is well-adapted for use by outdoorsmen of all types.

SUMMARY OF THE PREFERRED EMBODIMENT

At least some of the foregoing objects are accomplished by a tool kit having a pouch with a plurality of implement-receiving pockets therein which is constructed from a lightweight, pliable material. Preferably, the kit includes a plurality of tool implements, each of which is provided with a socket on an edge portion thereof and may perform one or more work functions.

The kit also preferably includes a lightweight foldable handle having an end adapted to be received in the socket of each of the tool implements, and which includes a pair of pivotally connected sections. The pivotally connected sections are joined by a detent device which fixes the position of the handle section in a folded position, an extended position or an intermediate position.

To facilitate the use of double-ended tool implements with a single folding handle, a suitable latching apparatus may be provided between each of the implements and the folding handle such that relative rotation of the tool implement with respect to the folding handle is effectively inhibited during use. The latching device is also useful to permit rotation of the tool implement through 90° or 180° to use the second end of a double-ended implement in a most effective manner.

To permit use of a saw-type cutting implement, the foldable handle may be provided with internally disposed projections at each remote end thereof. The handle cooperates with the detent device to hold a saw blade such that the saw blade and the handle define a stable generally triangular configuration.

BRIEF DESCRIPTION OF THE DRAWINGS

The above, and many other objects of the present invention will be apparent to those skilled in the art when this specification is read in conjunction with the attached drawings, wherein like reference numerals have been applied to like elements, and wherein:

FIG. 1 is a perspective view of a tool kit constructed in accordance with the preferred embodiment of the present invention;

FIG. 2 is a perspective view of the folding handle of the present invention as connected with a combination axe and hammer head;

FIG. 3 is a partial view of a shovel head attached to a corresponding end of the folding handle;

FIG. 4 is an enlarged, partially exploded view depicting apparatus for limiting relative rotation between the tool implement and the folding handle;

FIG. 5 is a perspective view of the folding handle with a pick head attached thereto;

FIG. 6 is a view of the folding handle with a saw blade connected thereto;

FIG. 7 is a bottom view of the handle in FIG. 6 showing the details of the internal saw blade supports;

FIG. 8 is a view in partial cross-section taken along the line 8—8 of FIG. 6;

FIG. 9 is a view in partial cross-section taken along the line 9—9 of FIG. 8; and FIG. 10 is a view in partial cross-section taken along the line10—10 of FIG. 8.

DESCRIPTION OF A PREFERRED EMBODIMENT

Illustrated in FIG. 1 is a compact lightweight tool kit 20 constructed in accordance with the present invention. The tool kit includes a container or pouch 22, which is provided with a plurality of pockets 24. The pouch may be constructed from a suitable pliable material such as canvas, nylon, leather, plastic and the like. The pockets are suitably attached to the pouch 22 as by sewing or glueing and such as tool implement placed therein to prevent unfettered movement thereof with respect to the other objects carried by the tool kit 20.

For flat storage the pouch 22 may be folded along a hinge line, as illustrated at 26 in FIG. 1. Alternately, the pouch 22 may be rolled and tied together with flexible members such as strings 28.

The pockets 24 may be spaced apart from one another such that any contact between objects carried therein is effectively inhibited. Moreover, the pouch 22 may be designed such that space is provided to accomodate additional pockets for storage of still other objects.

One pocket 24 is adapted to receive a handle 30. Turning now to FIG. 2, the handle 30 is illustrated in operative relationship with respect to a tool implement comprising an axe head 32. The axe head may be conventionally wedge shaped and includes both a cutting edge 34 and a generally flat hammer face 36 on an edge opposite the cutting edge 34. The cross-sectional configuration of the axe head 32 may be generally triangular such as illustrated in FIG. 2.

The hammer face 36 may be provided with a pair of ears 38 which are spaced apart from one another by a generally V-shaped notch 40. The ears 38 in combination with the V-shaped groove 40 permit the use of the axe head 32 to remove nails or similarly imbedded objects.

On triangularly shaped side or edge 42, which is generally perpendicular to the cutting edge 34 of the axe head 32, is provided with an internally threaded female recess 44. The recess 44 is adapted to receive an externally threaded male end portion or section 46 of the handle 30.

Thus, when attached to the handle 30, the axe head 32 enables an outdoorsman using the tool kit to cut with an axe as well as to drive and remove nails. The particular use being somewhat dependent on the orientation of the head 32 with respect to the handle 30 as will be described more fully hereinafter.

The handle 30 includes a first section or portion 48 and a second section or portion 50 which is pivotally connected with the first section 48.

Turning now to FIG. 3, the handle 30 is illustrated in operative position with respect to a shovel implement or head 52. The shovel head 52 is provided with an enlarged socket portion 54 in one edge thereof opposite to a generally pointed spade edge 56. The socket portion 54 has an internally threaded female recess 58 which may be threadably mounted on the externally threaded end portion 46 of the handle 30. When connected with the handle 30, the shovel head 52 enables an outdoorsman to use the tool kit for digging.

Cooperating with each tool implement and the handle 30 is a suitable rotation inhibiting or latching device 60 which is illustrated in somewhat greater detail in FIG. 4. The latching device 60 enables the handle 30 to be oriented relative to a tool head so that the maximum stiffness of the handle may be used when the handle is unfolded or extended. In a folded position, handle stiffness is not a pertinent consideration.

The device 60 includes three lugs or projections 62 which extend outwardly from the handle 30 at a position closely adjacent the externally threaded end portion 46. Each of the lugs 62 may be provided with a generally square cross-section as illustrated and includes a cap portion 64 and a shank portion 66. Alternatively, the shank portion 66 may have a circular or any other suitable cross-section. The same is true of the configuration of the cap portion 64.

In general longitudinal alignment with respect to the first handle portion 48 and in alignment with each of the projecting studs 62 is an elongate generally rectangular groove 68. Each groove 68 has an elongate direction which is generally parallel to the longitudinal axis of the handle 30. Each tool implement, as illustrated on the shovel head 52, includes one or more corresponding outwardly projecting lugs 70. Like the lugs 62, the lugs 70 include a cap portion 72 and a shank portion 74. The implement studs 70 may be square in cross section, as illustrated, circular, or any other suitable shape.

During the connection of the handle 30 to a tool implement such as the shovel head 32 depicted in FIG. 4, the external threads of the end portion 46 are engaged by the internal threads of the recess 58 and the handle 30 and the tool implement 52 screwed together until the handle is sufficiently tight. Thereupon, the implement lug 70 is arranged in general longitudinal alignment with a recess 68 and a handle lug 62 such that the handle 30 is oriented in the desired position with respect to the working edge or face of the tool implement 52.

With the implement lug 70 thus aligned with the handle lug 62, a resilient locking element 76 is installed to inhibit further rotation between the head 52 and the handle 30. The locking element 76 may be fabricated from spring steel and has a notch 78 at each end thereof such that one notch will cooperate with each of the aligned lugs 62, 70. The notch is received by the shank portion 66, 74 respectively, and parallel finger portions 80 at each end of the locking elements are retained on the corresponding lug 62, 70 by the cap portion 64, 72 respectively.

Returning briefly to FIG. 3 it will be observed that the locking element 76 assumes a deformed, concave configuration. This concave configuration is effected by selecting the longitudinal distance between the bottoms of the notches 78 (see FIG. 4) to be a value greater than the longitudinal spacing between lugs 62, 70 in their aligned configuration. The width of the locking element 76 is selected to be slightly less than the width of the corresponding recess 68 aligned with the two lugs 62, 70.

With the foregoing construction, portions of the parallel side edges of the locking element 76 may pass downwardly into the recess 68. The depth of the recess 68 is selected such that when the locking element 76 is in place, there is still a substantial clearance between the locking element 76 and the bottom of the recess 68. The additional clearance permits further deformation of the resilient locking element 76 so that the fingers 80 at one end portion thereof may be removed from engagement with the cap portion 64, 72 of one of the projections 62, 70 to effect the removal of the locking element 76. With the concave configuration depicted in FIG. 3, portions of the parallel edges of the locking element 76 are engaged radially within the recess 68 such that relative rotation between the locking element 76 and the handle 30 is substantially inhibited. With the position of the locking element 76 thus determined, a relative rotation of the shovel head 52 with respect to the handle 30 is likewise inhibited. In addition, the head may be oriented relative to the handle 30 to utilize the handle most effectively for the function being performed.

Turning now to FIG. 5, the handle is illustrated as connected with yet another tool implement, namely the pick head 82. The pick head is provided with a generally pointed end 84 and with a somewhat broader flattened and sharpened edge 86 at the opposite end thereof. Intermediate the pointed and sharpened edges 84, 86 and projecting from an edge face thereof, a collar 88 is provided that includes an internal recess 90 having threads therein.

The pick head 82 is connected to the handle 30 with the latching mechanism 60 as described above. To facilitate the optimum positioning of the handle 30 with respect to the pick head, the pick head collar 88 is provided with a pair of latched lugs 70, 70' which are positioned at approximately 180° with respect to one another. In this manner, the pick head may be positioned with respect to the handle 30 in either one of two positions located at 180° angles with respect to one another making possible the use of the handle 30 with its most rigid configuration presented to the impact derived from the pick head 82 contacting a hard surface.

Turning now to FIG. 6, the handle 30 is illustrated in an intermediate position in which it supports a saw blade 92. The intermediate position of the handle is selected in a convenient position between an extended position illustrated by the phantom lines 94 in FIG. 6 and between a closed or folded position illustrated by the phantom line 96.

The saw blade 92 is supported at each end by an internally disposed projection 98, 100 respectively (see FIG. 7) of the folding handle 30. The projection 98 is carried by the first handle portion 48 at an internally disposed location adjacent the threaded end portion 46 thereof. The projection 98 includes a canted finger 102 which is received in a hole 104 (see FIG. 1) of the saw blade 92. The end of the finger 102 is inclined toward the end portion 46. Each end of the saw blade 92 is provided with a conventional opening 104 (see FIG. 1).

The second projection 100 (see FIG. 7) is also provided with a canted finger 106 which extends through a correspondingly positioned hole in the saw blade 92. The end of the finger 106 is inclined toward an end of the second handle portion 50 and away from the other canted finger 102 to aid in holding the saw blade 92.

Returning briefly to FIG. 5, the first handle portion 48 includes a generally U-shaped cross-sectional configuration having an open side 110. Similarly, the second handle portion 50 also includes a generally U-shaped cross-sectional configuration narrower than that of the first handle portion 48 and having an open side 112 which, in the extended position, is in general longitudinal alignment with the open side 110 of the first handle section 48. By providing the aligned arrangement between the open sides 110, 112, the second handle portion 50 may be pivotally rotated about pivot assemblies 108 to the closed position with the relatively shorter second handle portion 50 being positioned within the U-shaped cross-section of the first handle portion 48 at the side 110. This arrangement of the closed handle provides compact storage of the handle in addition to a short handle for use with the tool implements.

It will be noted from FIG. 7 that the first handle portion 48 is pivotally connected to the second handle portion 50 be a pivot assembly 108. In fact, a pivot assembly 108 is provided on each side of the handle portion.

Turning now to FIG. 8, the handle pivot assembly 108 is illustrated in enlarged detail. As noted, there is preferably one of the pivot assemblies 108 on each side of the handle. Accordingly it will suffice to describe one of the pivot assemblies with the understanding that the other pivot assembly is identical and symmetrically located on the handle 30.

Each pivot assembly 108 includes a pivot stud 114 extending between the first handle portion 48 and the second handle portion 50. The pivot stud 114 has a bore 116 which extends substantially therethrough. At one end of the bore 116 is a generally radial shoulder portion 118 which projects radially inwardly and defines a guide opening 120 for the shank 122 of a pin 124. The end of the pivot stud 114 opposite from the shoulder 118 may be provided with a stud cap 126. The stud cap 126 may be threadably connected to the pivot stud 114 as illustrated in FIG. 8 or may be otherwise suitably connected thereto.

The stud cap 126 preferably extends laterally beyond the external surface of the pivot stud 114 to mechanically inhibit movement of the pivot stud 114 toward the first handle portion and from the second handle portion 150.

The external surface of the pivot stud 114 is provided with a seat portion having a rotationally assymetric or polygonal configuration such as the square illustrated in FIG. 10. The polygonal external configuration for the one end portion of the pivot stud 114 prevents relative rotation between the pivot stud 114 and the second handle portion 50.

The other end portion of the pivot stud 114 is a pivot section and is preferably provided with a rotationally symmetric external surface as illustrated by the circular external surface 128, shown in FIG. 9. The pivot section of the stud 114 extends from the second handle portion 50 to the shoulder 118 to provide a shaft-like mount for the adjacent first handle portion 48.

The shank 122 of the pin 124 may have a generally circular cross-section as illustrated in FIG. 9. Alternately, the shank 122 may be of a generally square cross-section. In either case the shank 122 has configuration that conforms to the opening 120 of the shoulder 118. When a rotationally asymmetric cross section is used, relative rotation between the pin 124 and the pivot stud 114 is inhibited. The end portion of the shank 122 is provided with a rotation limiting flange member 130 (see FIG. 10) having rotationally asymmetric external shape such as the square configuration depicted in FIG. 10. Returning to FIG. 8, the bore 116 is preferably provided with a polygonal or rotationally asymmetric cross-sectional configuration in the portion of the pivot stud 114 adjacent to the stud cap 126. For example, see the generally square cross-section depicted in FIG. 10. Thus, the flange member 130 conforms with the shape of the bore 116 to thereby limit rotation between the pin 124 and the pivot stud 114. As illustrated in FIG. 10, the flange portion 130 may be keyed to the pin shank 122 by a suitable key member 132 to prevent relative rotation therebetween.

With the pin shank 122 inserted into the bore 116 of the pivot stud, a suitable spring 134 (see FIG. 8) surrounds the pin shank 122 and rests against the shoulder 118 on one end and against the flange member 130 at its other end. In this manner, the spring 134 provides a resilient biasing force to urge the flange member 130 in the direction of the stud cap 126 such that the pin 124 is resiliently urged into the pivot stud 114.

The circular portion of the pivot stud 114 is received by a generally circular opening 136 in the first handle portion 48. The opening 136 has a diameter slightly larger than that of the pivot stud to permit free rotation therebetween and pivotally mount the handle portion 48 about the pivot stud 114.

The pin 124 is provided with one or more arms 138 which project laterally outwardly therefrom with an end portion 140 received in an appropriately sized recess 142 of the first handle portion 48. The end portion 140 is securely positioned in the recess 142 by the spring 134 to inhibit relative movement between the first handle portion 48 and the pin 124. Rotation between the pin 124 and the second handle portion 50 is prevented by the cooperation between the pin 124, the pivot stud 114 and the asymmetric cross-section of the seat portion of the pivot stud 114.

A suitable projection 144 extends outwardly from the handle 30 and provides a surface that may be gripped readily by the fingers of an operator. To position the first and second handle portions 48, 50, the projections 144 on each side must be grasped and the arm ends 140 drawn clear of the openings 142 against the resilience of the springs 134.

Returning briefly to FIG. 6 it will be observed that the first handle portion 48 is provided with two pair of recesses 142, 142'. One pair of recesses 142' is positioned such that the first handle portion 48 will align with the second handle portion 50 in the intermediate position to receive the saw blade 92. The other pair of recesses 142 is preferably aligned substantially longitudinally with respect to the handle 30 and serves to position the first and second handle portions 48, 50 respectively in both the extended position 94 and the folded position 96. If desired, additional pairs of recesses may be provided to establish a plurality of intermediate positions.

When using the handle 30 for a saw support, the generally triangular configuration is sufficiently rigid to support the saw. However, if added rigidity is desired, the fingers 102, 106 may be threaded and provided with wing nuts to secure the saw blade thereto.

The orientation of a given tool implement with respect to the handle 30 is determined by the rotation limiting member 60 (see FIG. 4) previously described. The tool implements are ordinarily attached to the handle 30 such that the handle presents the necessary stiffness in the direction required. For example, the extended folding handle has its poorest stiffness in the direction normal to the open sides 110, 112 (see FIG. 5). Accordingly, the tool implements may be connected to the handle 30 for use in a direction substantially coplanar with the open side 110 of the first handle portion 48. Alternately the open sides 110, 112 may be oriented toward the direction from which an impact will come, to make efficient use of the relatively greater stiffness in that configuration.

Turning briefly to FIG. 2 it will be observed that the axe head might be used in the configuration illustrated. However, to use the hammer face 36 it is desired to rotate the axe head 32 to an angle of 90° or 180° to make use of the relatively stiffer directions of the handle 30.

Each tool implement 32, 52, 82, 92 is preferably fabricated from a rust-proof steel such as stainless steel. In this manner, the tool implements require a minimum of care, may be kept clean and will have little tendency to soil the pouch 22 or other items which they may contact. In addition, because of the cutting, digging and striking functions to be performed by the tool implements, a hard material such as steel is highly desirable.

The handle 30 may be constructed of a suitable strong, hard, lightweight material such as aluminum or a metal alloy. The U-shaped configuration of the handle in combination with a hard and strong material provides a substantially reduced weight for a combination tool while maintaining its efficacy as a useful implement for an outdoorsman.

It should now be apparent to those skilled in the art that there has been provided in accordance with the present invention a novel tool kit which substantially satisfies the objects set forth above. Moreover, it will be apparent that numerous modifications, variations, substitutions and equivalents for the various elements and features of the invention described may be made without departing from the spirit and scope of this invention. Accordingly, it is expressly intended that all such variations, modifications and equivalents of the invention as defined by the appended claims be embraced thereby.

What is claimed is:

1. In a lightweight portable tool kit having container means and a plurality of tool implements designed to accomplish at least one tool function, an improved handle adapted to be threadably attached to at least one of the plurality of tool implements and adapted to support end portions of a different one of the tool implements, the improved handle comprising:

a first handle portion with a threaded end operable to be threadably connected with the at least one of the plurality of tool implements;

a second handle portion shorter than the first handle portion and having a first end;

position detent means providing a pivotal connection between the first handle portion and the second handle portion and operable to fix the relative position of the second handle portion with respect to the first handle portion at a folded position, an extended position and a position intermediate the folded and extended positions; and attachment means at the threaded end of the first handle portion and the first end of the second handle portion operable to support end portions of the different one of the tool implements when the first handle portion and the second handle portion are in the intermediate position.

2. The tool kit of claim 1 further including:

rotation limiting means cooperating with the first handle portion and the one of the plurality of implements to which it is threadably connected and being operable to inhibit relative rotation therebetween.

3. A lightweight portable tool kit comprising:

a plurality of tool implements, each tool implement being designed to accomplish one or more tool functions, and having an internally threaded female recess in an edge portion thereof;

handle means for connection to any one of the plurality of tool implements, having a first handle portion with an externally threaded male end operable to be received by the internally threaded female recess of each one of the plurality of tool implements, and having a second portion shorter than the first portion and pivotally connected thereto for movement between a folded position and an extended position;

position detent means for fixing the relative position of the second handle portion with respect to the first handle portion at the folded position, the extended position or a position intermediate the folded and extended position, the detent means providing a pivotal connection between the first portion and the second portion of the handle means;

rotation limiting means cooperating with the handle means and one of the plurality of implements to which it is threadably connected and being operable to inhibit relative rotation therebetween; and wherein the handle means further includes a substantially U-shaped cross-sectional configuration for the first portion such that the first portion includes an open side which receives the second portion in the closed position, a substantially U-shaped cross-sectional configuration for the second portion such that the second portion includes an open side which aligns with the open side of the first portion in the extended position, first lug means disposed internally of the first portion at the threaded end thereof, and second lug means dispossed internally of the second portion at the end thereof and operable in conjunction with the first lug means and the handle means in its intermediate position to provide a saw blade support.

4. The tool kit of claim 3 wherein the position detent means includes:

a pivot stud having a seat section and a pivot section, the pivot section having a circular external cross section, a pivot section bore, and being received in a circular opening of one of the first and second portions, and the seat section having a polygonal external cross section, a polygonal cross section bore coaxial with the pivot section bore, and being received within a correspondingly shaped opening of the other of the first and second portions;

a stud cap connected to the pivot stud at the polygonally shaped end thereof and projecting laterally beyond the polygonally shaped end to restrain the pivot stud relative to the other of the first and second portions;

a pin having an arm to engage one of a plurality of recesses in the surface of one of the first and second portions, and a shank coaxially disposed within the bore of the pivot stud and provided with a polygonally shaped end which cooperates with the polygonal bore to prevent relative rotation between the pin and the pivot stud; and resilient means carried between the pin and the pivot stud bore and operable to bias the pin end in the direction of the stud cap.

5. The tool kit of claim 3 wherein the rotation limiting means comprises:

a first projection extending laterally from the first portion and spaced from the threaded end thereof;

the first portion being provided with an elongate recess in general longitudinal alignment with the first projection;

a cooperating projection extending laterally from each of the plurality of tool implements at a position adjacent to the internally threaded bore and operable to be in general alignment with the first projection and the elongate recess when the corresponding tool implement is threadably connected to the handle means; and a resilient latching member having a projection-receiving notch in each end, a width slightly less than the width of the elongate recess, and a length greater than the distance between the first projection and the cooperating projection such that a portion of the latching member protrudes into the elongate recess to cooperate with the first projection and longitudinally fix the orientation of the latching member with respect to the handle means.

6. The tool kit of claim 3 wherein the plurality of tool implements includes a hammer head, an axe head, a pick head, and a shovel head and wherein the tool kit includes an elongate saw blade.

7. In a combination tool having a multipurpose tool head and a detachable handle means, an improved handle means comprising:

a first handle section having a first end portion adapted for connection to the tool head and having a second end portion;

a second handle section having an end portion pivotally connected to the second end portion of the first handle section for movement between a folded position and an extended position;

position detent means for relatively positioning the first handle section and the second handle section with respect to one another, the position detent means being located at the second end portion of the first section and at the end portion of the second section; and wherein the position detent means includes stud means having a rotationally asymmetric surface portion received by a conforming opening of one of the first and second handle sections and operable to prevent relative rotation between the detent means and the one handle section, and a rotationally symmetric surface portion received by a conforming opening of the other of the first and second handle sections and operable to pivotally support the other handle section with respect to the one handle, and pin means rotationally fixed with respect to the stud means, carried thereby, and operable to engage the other handle section to retain the first handle section and the second handle section in the folded position, the extended position or an intermediate position.

8. In a combination tool having a multipurpose tool head and a detachable handle means, an improved handle means comprising:

a first handle section having a first end portion adapted for connection to the tool head and having a second end portion;

a second handle section having an end portion pivotally connected to the second end portion of the first handle section for movement between a folded position and an extended position;

position detent means for relatively positioning the first handle section and the second handle section with respect to one another, the position detent means being located at the second end portion of the first section and at the end portion of the second section; and wherein the first handle section has a generally U-shaped cross section with an open side between the end portions thereof, and includes an internally disposed projection adjacent the first end portion;

wherein the second handle section has a generally U-shaped cross section with an open side between the end portions thereof being in general alignment with the open side of the first handle section in the extended position, and includes an internally disposed projection at the end portion remote from the position detent means; and wherein the first and second handle sections cooperate with the internally disposed projections in the intermediate position to effect a saw blade support.

* * * * *